US007784321B2

(12) United States Patent
Denker et al.

(10) Patent No.: US 7,784,321 B2
(45) Date of Patent: Aug. 31, 2010

(54) DEVICE FOR ADAPTING WORKING ROLLS TO A ROLLING LINE

(75) Inventors: Wolfgang Denker, Freudenberg (DE); Andreas Berendes, Kirchhundem (DE)

(73) Assignee: SMS Siemag Aktiengesellschaft, Duesseldorf (DE)

( * ) Notice: Subject to any disclaimer, the term of this patent is extended or adjusted under 35 U.S.C. 154(b) by 367 days.

(21) Appl. No.: 11/887,319

(22) PCT Filed: Oct. 12, 2005

(86) PCT No.: PCT/EP2005/010962

§ 371 (c)(1),
(2), (4) Date: Sep. 25, 2007

(87) PCT Pub. No.: WO2007/042060

PCT Pub. Date: Apr. 19, 2007

(65) Prior Publication Data

US 2009/0064750 A1 Mar. 12, 2009

(51) Int. Cl.
*B21B 31/07* (2006.01)
*B21B 31/30* (2006.01)
*B21J 9/18* (2006.01)

(52) U.S. Cl. ..... 72/244; 72/451

(58) Field of Classification Search ..... 72/244, 72/450–451, 237–239, 245–248
See application file for complete search history.

(56) References Cited

U.S. PATENT DOCUMENTS 679,413 A * 7/1901 Bunker ..... 72/244
2,635,492 A * 4/1953 Gettig ..... 72/244
3,908,426 A * 9/1975 Aramaki ..... 72/244
3,926,033 A * 12/1975 Forichon ..... 72/451
4,038,857 A * 8/1977 Eibe et al. ..... 72/244
4,213,509 A * 7/1980 Hafner ..... 177/199
4,237,715 A * 12/1980 Lutz ..... 72/244
4,751,837 A * 6/1988 Bohnenkamp ..... 72/244
5,479,809 A * 1/1996 Stachuletz et al. ..... 72/244

FOREIGN PATENT DOCUMENTS

EP 0310897 4/1989

OTHER PUBLICATIONS

Patent Abstract of Japan SP-59050905, Mar. 1984.
Patent Abstract of Japan JP-61063309, Apr. 1986.
Patent Abstract of Japan JP-07265919, Oct. 1995.

* cited by examiner

*Primary Examiner*—Dana Ross
*Assistant Examiner*—Mohammad Yusuf
(74) *Attorney, Agent, or Firm*—Abelman, Frayne & Schwab

(57) ABSTRACT

The invention relates to a device for adapting working rolls, in particular of four-high stands, to a rolling line with at least one pair of wedges (1, 1') in a region between parallel, spaced from each other, rolling mill stands (2, 2'), which are displaceable along a horizontal slideway relative to the stands (2, 2') by toggle lever adjusting means. To this end, the wedges (1, 1') of the wedge pair are connected with each other at a fixed distance from each other, and for their displacement an arrangement of two toggle levers (4, 5) is provided of which one lever (4) is supported on one wedge (1) with at least one articulated joint (6) and another lever (5) is supported on an opposite stand (2') also with at least one articulated joint, and both levers (4, 5) are connected with each other by a longitudinally adjustable toggle joint (7).

10 Claims, 2 Drawing Sheets

DEVICE FOR ADAPTING WORKING ROLLS TO A ROLLING LINE

Figure 1:
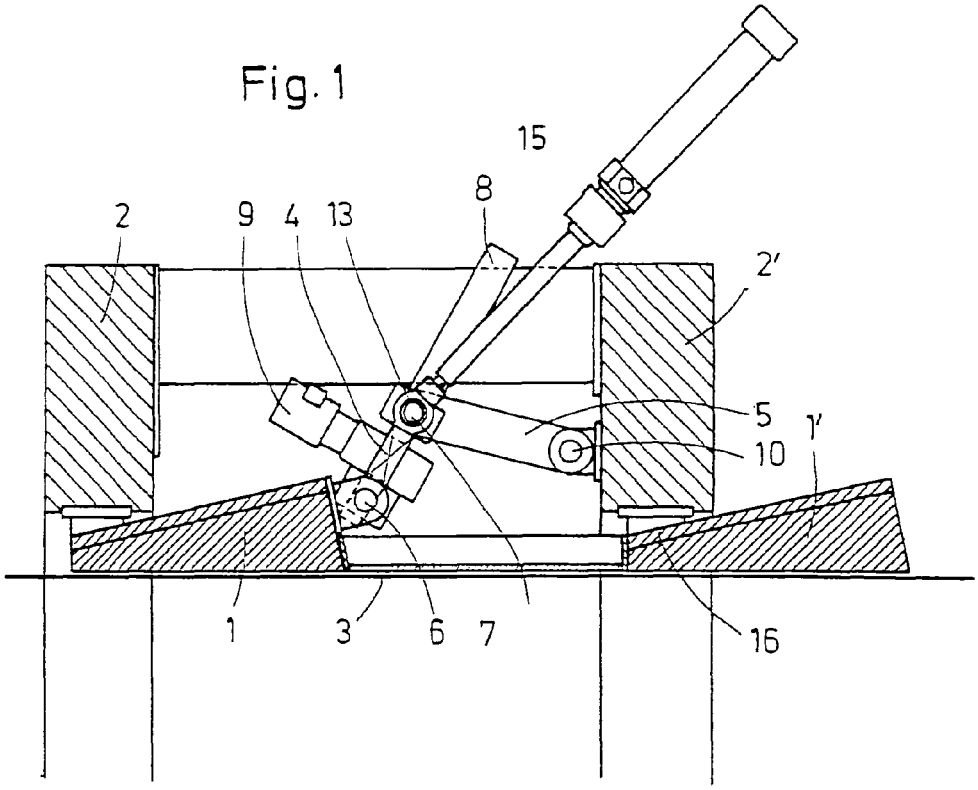

The invention relates to a device for adapting working rolls, in particular of four-high stands, to a rolling line with at least one pair of wedges in a region between parallel, spaced from each other, rolling mill stands, which are displaceable along a horizontal slideway relative to the stands by toggle lever adjusting means.

Different types of adjusting means, such as wedge adjusting means, spindle reciprocating drives, stepped wedges, manual plate shims, hydraulic cylinders, spindle adjusting means, and different configuration of toggle lever means are known for a variable adjustment of the upper edge, e.g., of a lower working roll of a rolling mill stand.

These means or devices require, among others, that the rolling mill stands contain an expensive mother bore in the top brace of very long wedges, or necessitates a hydraulic valve stand for electrical control. Occasionally, clamping devices are necessary, or the operational personal must often change the back-up rolls or shims, and it is expensive to wait for them.

Cylinder-operating adjusting means is quick-acting, however, because of the necessary self-locking, and can be used only for small angles. In contrast, spindle-displaceable wedge adjusting means is relatively slow.

With regard to the state of the art, a number of documents disclose devices for adaptation of the upper edge of the lower working roll to the rolling line.

European patent EP 0 513 946 B1 discloses a device for adapting the upper edge of the lower working roll of rolling mill stands, in particular four-high stands, to the rolling line by means of a pair of wedges below each lower roll chocks, consisting of a lower wedge element, which can be displaced horizontally in the axial direction of the roll, and an upper wedge element, which can only be displaced in the vertical direction, the wedge surfaces of these elements lying one on top of the other during the rolling operation. Each upper wedge element can be raised and lowered together with the respective roll chocks by means of a lifting device. The wedge surfaces of the two wedges are stepped, wherein the steps are engaged into each other to support the wedge elements vertically.

European patent EP 0 231 445 B1 discloses a method of vertical redisposition of rolls in rolling mill stands for equalizing the upper edge of the lower working roll with the rolling line and for the exchanging of the rolls, in particular in four-high roll stands, equipped with a roll changing carriage, which is movable in longitudinal direction of the rolls and displays exchangeable stepped plates of variable thickness or height for the support of the chocks of the back-up rolls, as well as vertical lifting elements for the meantime support of the chocks. The redisposition is carried out in such a way that in the case of several stepped plates of different height and starting with the lowest step, those are raised, respectively, steplessly each time by means of a lifting element of short vertical stroke until the lower step has reached the level of the next higher step, for which the vertical listing elements then meantime take over the support of the chocks until the lifting element of short vertical stroke has traveled back to its lower setting and the next higher step plate has been moved below the chocks.

The document DE-OS 25 13 666 describes a rolling mill stand with a spindle-operated wedge adjusting means for adjusting or readjusting the pass height with a pressure cylinder for lifting the weight of the lower roll set during operation of the wedge adjusting device. In each rolling mill stand of the rolling mill, two pressure cylinders are provided.

The document DE 28 06 525 C2 describes a device for removing rolls from rolling mill stands, in particular four-high rolling mill stands, and for adjusting the upper edge of the lower working roll to the rolling line with pull-out carriage. On the pull-out carriage, there are provided several fitted pieces having different thicknesses which are pushed beneath the chocks with a displacement drive. For supporting the chocks, lifting devices are provided. The fitted pieces are displaceable in a path provided on the pull-out carriage, and the lifting devices are arranged on opposite sides of the displacement frame in the pull-out carriage.

U.S. Pat. No. 4,237,715 discloses a mechanism for a vertical adjustment of a lower back-up roll of four-high rolling mill to a pass-line. There is provided means for lifting the chocks so that upon lifting the same, stepped spacing elements can be pushed between the chocks and the rolling mill stand.

Document JP 7 26 59 19 describes a device for adjusting of the pass line with displaceable stepped wedges insertable between chocks of the lower back-up rolls and the rolling mill stand. For changing the spacing, the insertable wedges have stepped support surfaces and a smooth opposite surface. To prevent undesirable deviations, the wedges are mounted with the smooth surface facing upwardly, and with steps facing downwardly.

Document DE-OS 2 241 833 discloses a roll adjusting device for adjusting rolls having different widths in the same rolling mill stand. To this end, there are provided adjusting members with bearing surfaces for the rolls having different support distances of the chocks.

The adjusting members have, on their sides adjacent to the thrust pieces of the rolls and in the direction of the roll axis flat surfaces extending parallel thereto and, on opposite sides, wedge-shaped inclined surfaces which rest on the inclined surfaces of wedges displaceable in the direction of the roll axis. The displaceable wedges have, on their sides opposite the wedge-shaped inclined surfaces, flat surfaces extending parallel to the roll axis and sliding along flat surfaces provided in the rolling mill stand.

German Publication DE-OS 37 37 807 A1 discloses an invention that relates to a rolling mill, in particular a cold-rolling mill with at least two, in particular four to ten, mainly essentially superimposed rolls, wherein a hydraulic medium, namely, via at least one, conveniently at least two, hydrostatic bearing element(s) and hydraulic cylinders act directly on the outer jackets of the roll barrels. There is provided a wedge adjustment with wedge surfaces mutually displaceable parallel to the roll axes is provided underneath of conveniently at least two hydrostatic bearing elements of the lower or lowermost roll(s) acting on the roll barrel(s), conveniently also for compensating the wear of the lower series of rolls or the lowermost roll. Wedge adjustment is subject to the action of a hydraulic actuating (differential) cylinder with its axis arranged parallel to the roll axes, which cylinder or its actuator or its pressure medium supply is actuatable to control the elastic bending line(s) of the lower roll(s) by signal transmitters. This is effected particularly indirectly, mainly via a computer control, the computer comparing the input set values for the rolling stock to the actual values of the signal transmitters which are located in the surface flatness measuring device. In addition, a control by means of hydraulic lifting cylinders directly acting on the roll bearings or on the roll bearing necks of back-up rolls possibly being combined therewith.

German application DE 37 37 100 A1 discloses control in rolling mills. For providing a rolling force rolling mills and colander are operated by hydraulic cylinders. The rolling mill stands can weight, at four-high sheet rolling mills, up to 8,000 tons. There is suggested to use mechanical roll gap change, with a most possible rolling force, with toggle lever means and roll spindle and roll supporting elements. This should noticeably reduce the necessary control forces, which provide for precise adjustment and enable adjustments in the μ-region.

Proceeding from the above-mentioned state of the art, the object of the invention is to develop a mechanically quick-acting and simply operating device for high forces for a variable pass-line adjustment in rolling mill stands.

For achieving this object, the invention proposes that in the device for a pass-line adjustment according to the preamble of claim 1, the wedges of the wedge pair be connected with each other at a fixed distance from each other, that for their displacement an arrangement of two toggle levers be provided of which one lever is supported on one wedge with at least one articulated joint and another lever is supported on an opposite stand also with at least articulated joint, and both levers are connected with each other by a longitudinally adjustable toggle joint.

Functionally, the invention is based on a rapid displacement of adjusting wedges in a roll position and, for replacement of rolls, rapid withdrawal of the wedges with toggle lever means.

According to a further modification of the inventive device for a pass-line adjustment, it is proposed that the toggle joint be connected with a piston rod of power means which is supported by an articulated joint and displaces the toggle lever means between an angular position and a linear position by reciprocating the piston rod out and in.

According to an advantageous embodiment of the invention, it is suggested that the toggle joint be longitudinally adjustable with a threaded spindle and be arranged on one of the levers.

It is preferable that the toggle joint is longitudinally adjustably arranged on the lever supported on the one wedge, being adjustable by the threaded spindle with an add-on drive motor.

A modification of the inventive concept consists in that the toggle joint includes a truss which is arranged transverse to an axis of the lever and against which ends of the lever and of the piston rod of the power means are supported, respectively.

According to an embodiment of the invention, each wedge has a slide surface provided on its upper surface.

According to another embodiment, the drive motor is connected with the truss by a worm gear.

Further, the invention proposes that the piston rod has hydraulic means for its lengthening provided in a cylinder of the power means.

And, finally, the invention proposes that the cylinder of the power means be arranged for pivotal movement about a horizontal axis.

In the drawings an embodiment of the invention is shown purely schematically.

Figure 2:
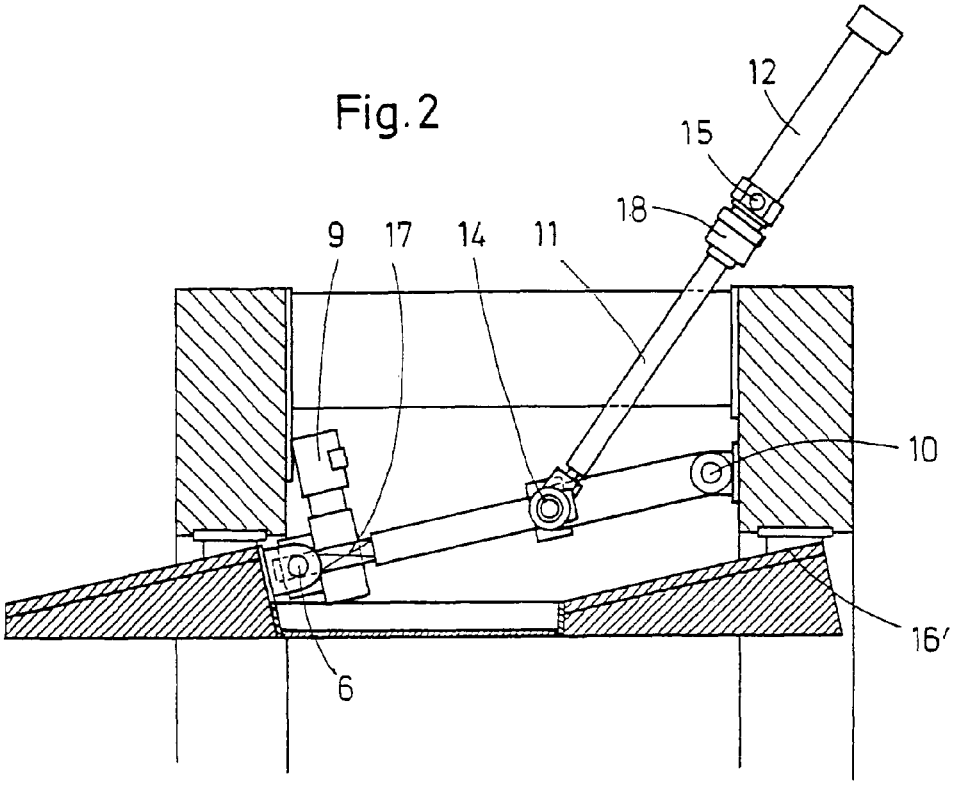
Figure 3:
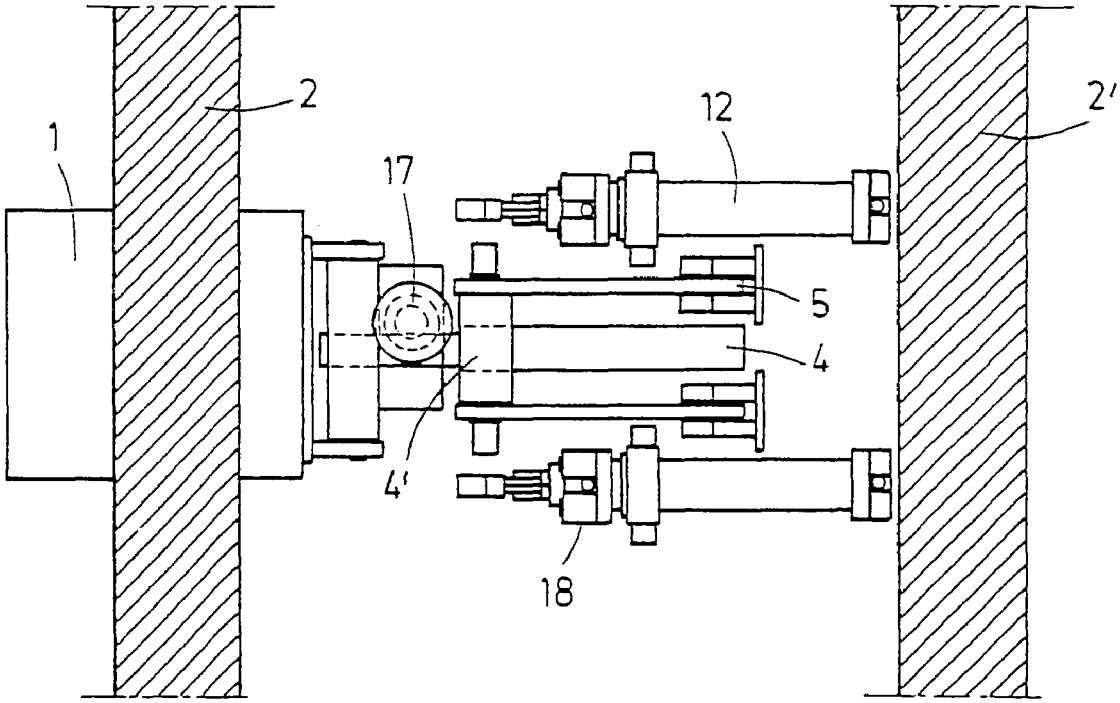

It is shown in:

FIG. 1 a side view of a device for adapting a roll upper edge to the pass line of a rolling mill stand in an angular position;

FIG. 2 a side view of the device according to FIG. 1 in a linear position; and FIG. 3 a plan view of the device according to FIG. 1 or 2.

The three figures show, respectively, in agreement with each other, a device for adapting the upper edge of the lower working roll to the rolling line, in particular of four-high stands, with a pair of wedges 1, 1' below roll chocks, including a pair of connected with each other, at a fixed distance, wedges 1, 1' which are arranged on a horizontal slideway 3 between parallel, spaced from each other, rolling mill stands 2, 2' and are displaceable relative to the stands by a toggle lever adjusting means 13, 14, wherein, for adjusting, two toggle levers 4, 5 are provided of which one lever 4 with a horizontal articulated joint 6 is supported on the inner side of the first wedge 1 for longitudinal displacement by an add-on motor 9 via a threaded spindle 8, and the other lever 5 provides an articulated connection between the second stand 2' and the its toggle joint 7 and is supported via a horizontal articulated joint 10 on the inner side of the second stand 2', and wherein the toggle joint 7 is displaced by a piston rod 11 of power means 12 either in an angular position 13 or in a linear position 14, pivoting about a horizontal articulated joint 15 and providing for lengthening of the piston rod 11.

Each wedge 1, 1' has its upper surface formed as an inclined smooth surface 16, 16'.

Further, the drive motor 9 is connected with a truss 4 by a worm gear 17'. Still further, the piston rod 11 is provided, in the cylinder of the power means 12, with a hydraulic device 18 for its lengthening. The cylinder of the power means 12 is arranged for a pivotal movement about a horizontal axis 15.

With the device according to the present invention, it is advantageously achieved that the rolling mill stand is put down only for several seconds. With in-line rolling mill stands, it means using smaller strip accumulator because each second can directly lead to reduction of the necessary storage length.

Previous adjustment means could be open by about 20 mm per second, whereas this one achieves the same aim with up to 40 mm per second. The adjustment of an exact roll position for a constant pass line at different roll diameters is carried out with a spindle formed as lever arm of a toggle lever. By rotating the spindle, e.g., with a drive motor, the operational lever length of the toggle lever can be so changed that the retractable wedge is positioned in its vertical position. Under the rolling force, the wedge is fixedly positioned because it is supported on the stand spar by a stretched toggle lever.

Self-locking is insured in the thread. The device can be arranged in both upper and lower tie beam of the rolling mill stands. Another advantage consists in that all components are easily treatable production parts.

The invention claimed is:

1. A device for adapting working rolls of rolling mill stands (2, 2') arranged parallel to each other and spaced from each other, the device comprising at least one pair of wedges (1, 1') arranged in a region between the adjacent rolling mill stands (2, 2'), connected with each other at a fixed distance from each other, and displaceable along a horizontal slideway relative to the rolling mill stands (2, 2'); and toggle lever adjusting means for displacing the wedges (1, 1 ') and having two toggle levers (4, 5), at least two articulated joints (6, 10) for supporting, respectively, one (4) of the two levers on a wedge (1) associated with one (2) of the two stands (2, 2') and another (5) of the two levers on an opposite one of the two stands (2'), and a longitudinally adjustable toggle joint (7) for connecting the two levers (4, 5) with each other.

2. A device according to claim 1, further comprising power means (12) for displacing the two toggle levers (4, 5) between an angular position (13) and a linear position (14) and including a linearly displaceable piston rod (11) directly connected with the toggle joint (7).

3. A device according to claim 1, further comprising a threaded spindle (8) for longitudinally adjusting the toggle joint (7), and wherein the toggle joint (7) is supported on one of the levers (4, 5).

4. A device according to claim 3, wherein the toggle joint (7) is supported on the one (4) of the two levers, the device further including an add-on motor (9) for longitudinally displacing the toggle joint (7) via the threaded spindle (12).

5. A device according to claim 2, wherein the toggle joint (7) includes a truss (4') which is arranged transverse to an axis (X-X) of the one of two levers (4) and against which respective ends of the another of the two levers (5) and the piston rod (11) of the power means (12) are supported.

6. A device according to claim 1, wherein each wedge (1, 1') has a slide surface (16, 16') provided on its upper surface.

7. A device according to claim 5, comprising an add-on motor (9) for displacing the toggle joint (7), and a worm gear (17) for connecting an add-on motor (9) with the truss (4').

8. A device according to claim 2, wherein the power means (12) includes a cylinder in which the piston (11) is displaceable in and out for displacing the two toggle levers (4, 5) between the angular and linear positions (13, 14) thereof, respectively.

9. A device according to claim 8, wherein the cylinder is pivotal about an axis (15).

10. A device according to claim 1, wherein the at least two articulated joints (6, 10) and the toggle joint (7) are all pivotable about respective horizontal pivot axes.

* * * * *